US007209104B2

(12) United States Patent
Nakajima et al.

(10) Patent No.: US 7,209,104 B2
(45) Date of Patent: Apr. 24, 2007

(54) DISPLAY APPARATUS AND PORTABLE TERMINAL WHICH USES D/A CONVERSION CIRCUIT

(75) Inventors: Yoshiharu Nakajima, Kanagawa (JP); Yoshitoshi Kida, Kanagawa (JP)

(73) Assignee: Sony Corporation, Tokyo (JP)

( * ) Notice: Subject to any disclaimer, the term of this patent is extended or adjusted under 35 U.S.C. 154(b) by 335 days.

(21) Appl. No.: 10/442,351

(22) Filed: May 21, 2003

(65) Prior Publication Data

US 2003/0234800 A1 Dec. 25, 2003

(30) Foreign Application Priority Data

May 31, 2002 (JP) ..... 2002-159031

(51) Int. Cl.
*G09G 3/36* (2006.01)

(52) U.S. Cl. ..... 345/89; 345/98

(58) Field of Classification Search ..... 345/87–100, 345/204–213

See application file for complete search history.

(56) References Cited

U.S. PATENT DOCUMENTS 5,828,357 A * 10/1998 Tamai et al. ..... 345/89
6,236,388 B1 * 5/2001 Iida et al. ..... 345/698
6,373,419 B1 * 4/2002 Nakao ..... 341/154
6,459,395 B1 * 10/2002 Kida et al. ..... 341/126
6,515,676 B1 * 2/2003 Kasai et al. ..... 345/629
6,839,043 B2 * 1/2005 Nakajima ..... 345/87
6,879,174 B2 * 4/2005 Uchida ..... 324/765

FOREIGN PATENT DOCUMENTS

JP 07-312689 * 11/1995

* cited by examiner

*Primary Examiner*—Richard Hjerpe
*Assistant Examiner*—Jean Lesperance
(74) *Attorney, Agent, or Firm*—Robert J. Depke; Rockey, Depke, Lyons & Kitzinger LLC.

(57) ABSTRACT

A black-level reference-voltage generation circuit is disposed in a vicinity of an input-and-output pad section, and a power-supply line for the black-level reference-voltage generation circuit is connected to a power-supply line for a reference-voltage generation circuit for the other gradation levels at a position in a vicinity of the input-and-output pad section. With this, the resistance of the wiring resistor of the power-supply line of the black-level reference-voltage generation circuit is made as low as it can be ignored. As a result, a voltage drop caused by the wiring resistor of a black-level reference voltage is eliminated.

22 Claims, 10 Drawing Sheets

PRIOR ART

PRIOR ART

PRIOR ART

DISPLAY APPARATUS AND PORTABLE TERMINAL WHICH USES D/A CONVERSION CIRCUIT

This application claims priority to Japanese Patent Application Number JP2002-159031 filed May 31, 2002 which is incorporated herein by reference.

BACKGROUND OF THE INVENTION

1. Field of the Invention

The present invention relates to display apparatuses and portable terminals, and more particularly, to a display apparatus which uses a reference-voltage-selection-type D/A conversion circuit in a digital-type horizontal driving circuit that writes a display signal into each pixel of a display section, and a portable terminal to which the display apparatus is mounted as a screen display section.

2. Description of the Related Art

In the field of flat-panel-type display apparatuses, typical of which are liquid-crystal display apparatuses and electroluminescence (EL) display apparatuses, so-called driving-circuit-united-type display apparatuses have been developed in order to make the frames of the panels smaller and make the panels thinner. In the driving-circuit-united-type display apparatuses, a display section in which pixels are arranged in a matrix manner and peripheral driving circuits for driving the display section are mounted on a transparent, insulating substrate as a unit.

The peripheral driving circuits of the display apparatuses include a vertical driving circuit for selecting pixels in the display section in units of lines and a horizontal driving circuit for writing display data into each pixel in the selected line, as typical driving circuits. There are an analog-type horizontal driving circuit and a digital-type horizontal driving circuit. The digital-type horizontal driving circuit includes a D/A conversion circuit for converting a digital display signal to an analog display signal. As D/A conversion circuits, reference-voltage-selection-type D/A conversion circuits are known, in which a plurality of reference voltages corresponding to the number of gradation levels is generated by a reference-voltage generation circuit, and a reference voltage corresponding to a digital display signal is selected among the plurality of reference voltages and output as an analog display signal.

FIG. 9 shows a basic structure of the reference-voltage generation circuit. The reference-voltage generation circuit 100 according to the basic structure uses a resistor division (voltages divided by resistors). More specifically, when the number of gradation levels is "n", the voltage between a first reference potential VA and a second reference potential VB is divided by (n−1) resistors, R1 to Rn−1, connected in series. With this, (n−2) reference voltages, V1 to Vn−2, are obtained at voltage-division points. When a reference voltage V0 is set to the reference potential VA, and a reference voltage Vn−1 is set to the reference potential VB, a total of n reference voltages, V0 to Vn−1, are generated.

The reference-voltage generation circuit 100, shown in FIG. 9, has a structure used when it is mounted on liquid-crystal display apparatuses. In liquid-crystal display apparatuses, alternating-current (AC) inversion driving is employed which inverts the polarity of a display signal at a certain interval, in order to prevent the resistivity (resistance unique to a material) of the liquid crystal and others from deteriorating, the deterioration being caused by the continuous application of a direct-current (DC) voltage having the same polarity to the liquid crystal. To this end, switches SW1 to SW4 are turned on (closed) and off (opened) by timing pulses $\phi 1$ and $\phi 2$ generated alternately in synchronization with AC inversion, in the reference-voltage generation circuit 100.

In the reference-voltage generation circuit 100, when the timing pulse $\phi 1$ is generated at certain inversion timing of AC inversion, since the switches SW1 and SW4 are turned on, a positive power-supply voltage VCC is given as the first reference potential VA, and a negative power-supply voltage VSS (for example, a ground level) is given as the second reference potential VB. When the timing pulse $\phi 2$ is generated at the next inversion timing, since the switches SW2 and SW3 are turned on, the negative power-supply voltage VSS is given as the first reference potential VA, and the positive power-supply voltage VCC is given as the second reference potential VB.

When a driving-circuit-united-type display apparatus is structured, since various driving circuits are mounted on a substrate having a limited size, a restriction is given to the position of the reference-voltage generation circuit 100 on the substrate. Especially when horizontal driving circuits are arranged above and below a display section, the reference-voltage generation circuit 100 needs to be disposed at a position which has an equal distance from the above and below horizontal driving circuits, that is, inevitably, an intermediate position adjacent to the display section, on the substrate.

An input pad section for inputting from the outside of the substrate into the inside of the substrate, display data, a master clock MCK, a horizontal synchronization signal Hsync, a vertical synchronization signal Vsync, and the power-supply voltages VCC and VSS is provided at an end of the substrate on either the above side or the below side of the display section. For this reason, especially when the reference-voltage generation circuit 100 is arranged at the intermediate position adjacent to the display section, the power-supply lines of the power-supply voltages VCC and VSS need to path through long on the substrate from the input pad section to the reference-voltage generation circuit 100, and their wiring lengths are long. This arrangement of the power-supply lines on the substrate makes the wiring resistance of the power-supply lines large.

When the wiring resistor of the VCC power-supply line is called Rvcc and the wiring resistor of the VSS power-supply line is called Rvss, as shown in FIG. 10, the reference potentials VA and VB are reduced by a voltage $\alpha$ equal to Iref×Rvcc or a voltage $\beta$ equal to Iref×Rvss due to the existence of the wiring resistors Rvcc and Rvss, where Iref indicates DC current flowing through the resistors R1 to Rn−1, as shown in a waveform view of FIG. 11. The wiring resistors Rvcc and Rvss also include the switching resistors of the switches SW1 to SW4.

The reference voltage V0, which is equal to the reference potential VA, is used for a black level (black voltage), and the reference voltage Vn−1, which is equal to the reference potential VB, is used for a white level (white voltage). Therefore, when the reference potentials VA and VB are reduced due to the arrangement of the VCC and VSS power-supply lines in the-substrate, since the black level or the white level is reduced, the contrast ratio decreases and the image quality is strikingly reduced. In normally-white-mode liquid-crystal display apparatuses, the reduction of the black level especially reduces the image quality.

SUMMARY OF THE INVENTION

The present invention has been made in consideration of the above issues. An object of the present invention is to provide a display apparatus which has a sufficient contrast ratio to allow high-quality images to be displayed even when the display section and the reference-voltage generation circuit are mounted on the same substrate, and to provide a portable terminal having the display apparatus as a screen display section.

The above object is achieved in one aspect of the present invention through the provision of a display apparatus including a display section in which pixels are arranged in a matrix manner on a transparent, insulating substrate; and a reference-voltage generation circuit mounted on the transparent, insulating substrate together with the display section, for generating a plurality of reference voltages corresponding to the number of gradation levels, wherein the reference-voltage generation circuit includes a first voltage generation circuit for a black level, a white level, or the black and white levels, and a second voltage generation circuit for the other gradation levels, the first and second voltage generation circuits being disposed at different areas on the transparent, insulating substrate, and the first voltage generation circuit is disposed in a vicinity of an input section for inputting electric power from the outside of the substrate into the inside of the substrate. The display apparatus is mounted as a screen display section on portable terminals typical of which are personal digital assistants (PDAs) and portable telephones.

The above object is achieved in another aspect of the present invention through the provision of a portable terminal including a display apparatus as a screen display section, wherein the display apparatus includes a display section in which pixels are arranged in a matrix manner provided on a transparent, insulating substrate; and a reference-voltage generation circuit mounted on the transparent, insulating substrate together with the display section, for generating a plurality of reference voltages corresponding to the number of gradation levels, wherein the reference-voltage generation circuit includes a first voltage generation circuit for a black level, a white level, or the black and white levels, and a second voltage generation circuit for the other gradation levels, the first and second voltage generation circuits being disposed at different areas on the transparent, insulating substrate, and the first voltage generation circuit is disposed in a vicinity of an input section for inputting electric power from the outside of the substrate into the inside of the substrate.

In the display apparatus having the above-described structure, and in the portable terminal to which the display apparatus is mounted as a screen display section, since the first voltage generation circuit just outputs a power-supply voltage VCC or VSS as is as a black-level reference voltage, a white-level reference voltage, or black-level and white-level reference voltages, the circuit structure of the first voltage generation circuit is simple, and its circuit scale is quite small. Therefore, unlike the second voltage generation circuit, the first voltage generation circuit has no limitation on its arrangement position on the transparent, insulating substrate, and can be disposed at any position. Consequently, the first voltage generation circuit can be easily disposed in a vicinity of the input section (input pad section) for inputting electric power from the outside of the substrate into the inside of the substrate. When the first voltage generation circuit is disposed in a vicinity of the input section, the power-supply line of the first voltage generation circuit can be connected to the power-supply line for supplying electric power to the second voltage generation circuit, in a vicinity of the input section or at the outside of the substrate. With this, since the power-supply line of the first voltage generation circuit does not need to path through long on the substrate and therefore its wiring length becomes short, the resistance of the wiring resistor of the power-supply line is as low as it can be ignored. As a result, since a voltage drop caused by the resistor of wiring for the black-level reference voltage, the white-level reference voltage, or the black-level and white-level reference voltages is eliminated, a sufficient contrast ratio is obtained.

DESCRIPTION OF THE PREFERRED EMBODIMENTS

Figure 1:
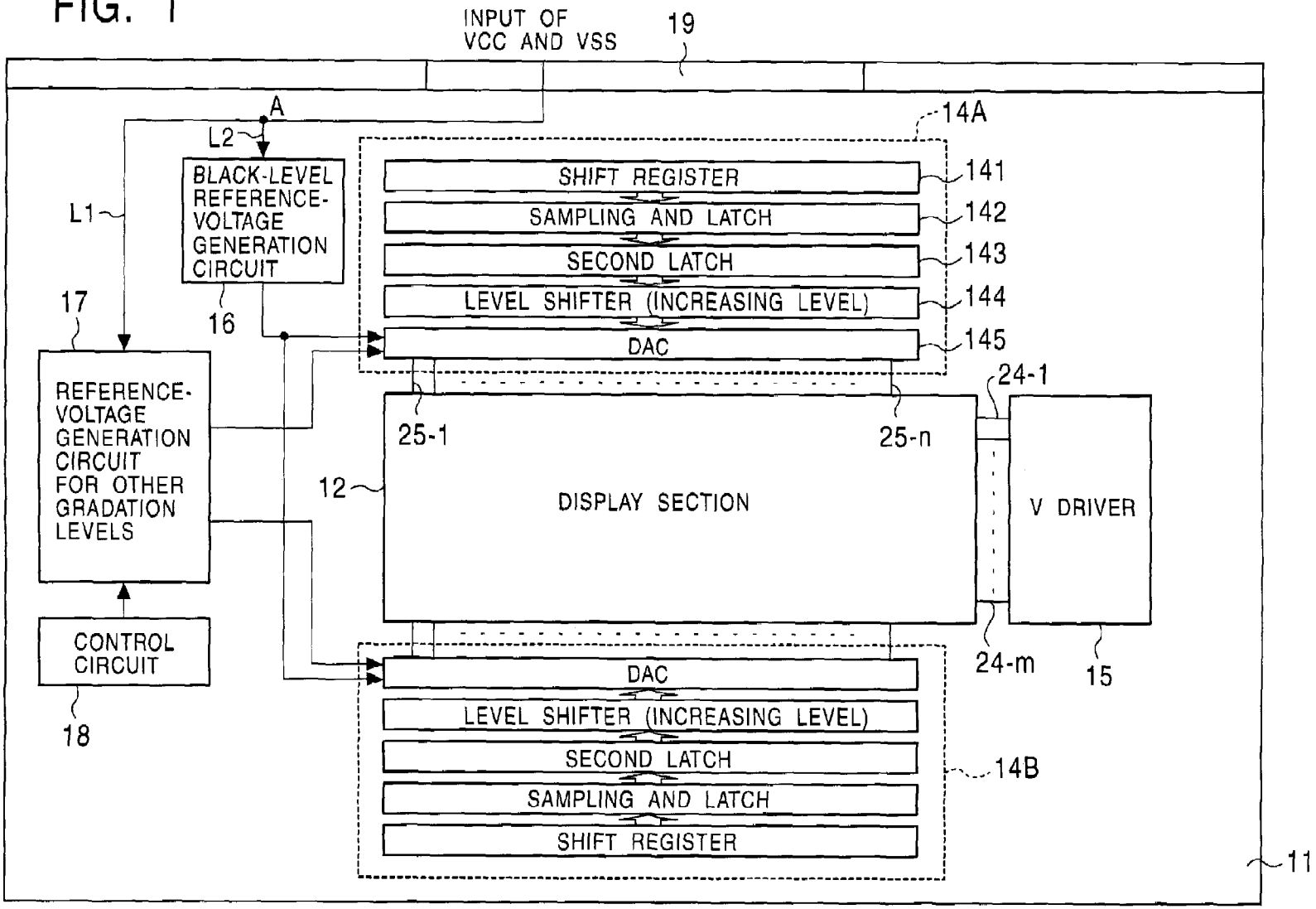
FIG. 1 is a block diagram showing an example structure of a liquid-crystal display apparatus which serves as an example of a driving-circuit-united-type display apparatus according to a first embodiment of the present invention.

Embodiments of the present invention will be described below in detail by referring to the drawings.

First Embodiment

FIG. 1 is a block diagram showing an example structure of a liquid-crystal display apparatus which serves as an example of a driving-circuit-united-type display apparatus according to a first embodiment of the present invention. In FIG. 1, a display section (pixel section) 12 in which pixels are arranged in a matrix manner is formed on a transparent, insulating substrate, for example, on a glass substrate 11. The glass substrate 11 is disposed oppositely to another glass substrate with a predetermined gap provided therebetween, and a liquid-crystal material is sealed between the substrates to form a display panel (LCD panel).

Figure 2:
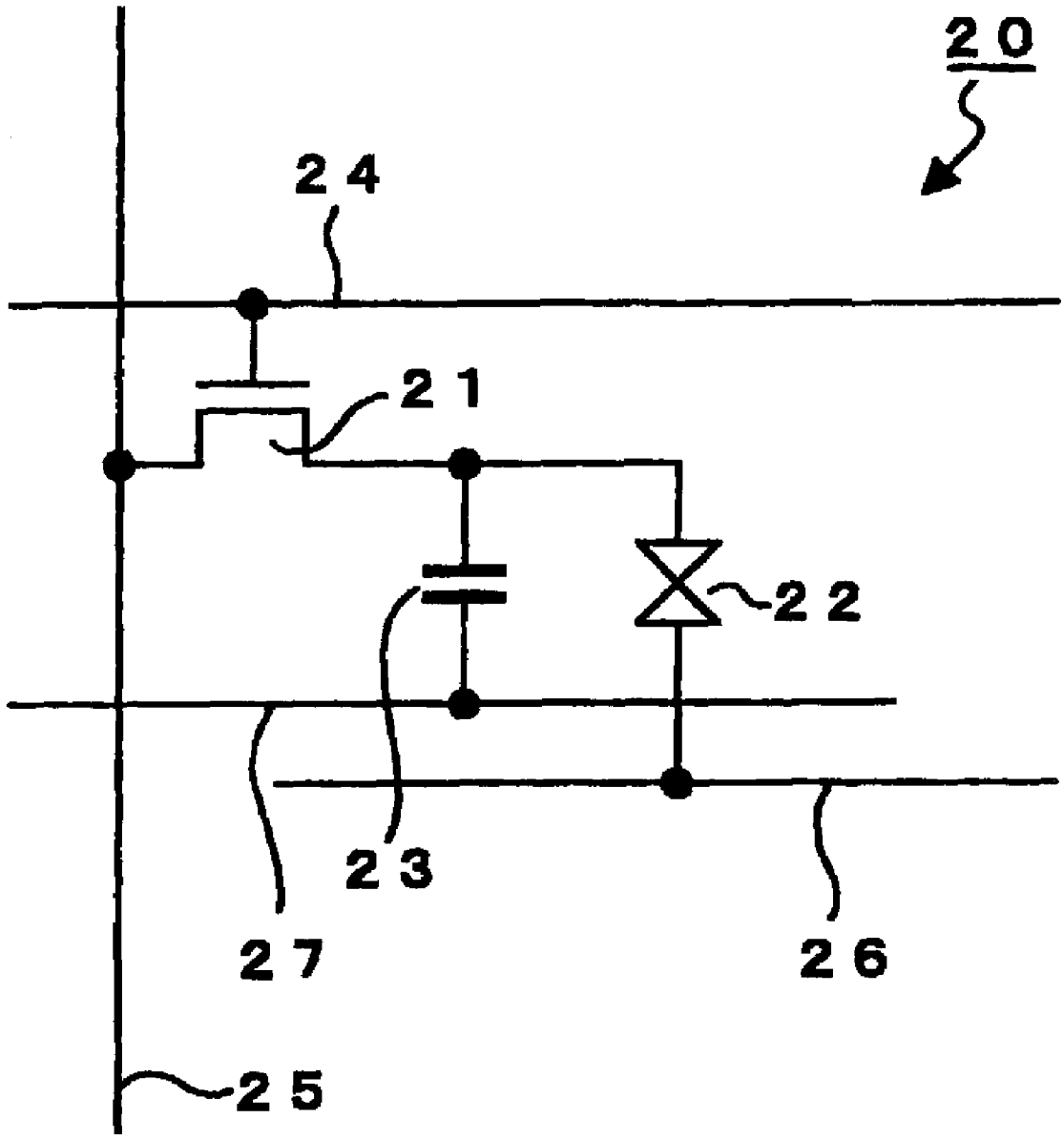
FIG. 2 is a circuit diagram showing an example structure of a pixel in a display section.

FIG. 2 shows an example structure of a pixel in the display section 12. Each of the pixels 20 arranged in a matrix manner has a thin-film transistor (TFT) 21 serving as a pixel transistor, a liquid-crystal cell 22 of which the pixel electrode is connected to the drain electrode of the TFT 21, and a holding capacitor 23 of which one electrode is connected to the drain electrode of the TFT 21. The liquid-crystal cell 22 means a liquid-crystal capacitor formed between the pixel electrode and an opposite electrode disposed oppositely thereto.

In this pixel structure, the gate electrode of the TFT 21 is connected to a gate line (scanning line) 24, and the source electrode thereof is connected to a data line (signal line) 25. The opposite electrode of liquid-crystal cell 22 is connected to a VCOM line 26, to which the opposite electrodes of all pixels are connected. A common voltage VCOM (VCOM potential) is applied through the VCOM line 26 to the opposite electrode of the liquid-crystal cell 22 and to those of the other cells in common. The other electrode (terminal at an opposite-electrode side) of the holding capacitor 23 is connected to a CS line 27, to which the corresponding electrodes of all the capacitors are connected.

When 1H (H indicates a horizontal period) inversion driving or 1F (F indicates a field period) inversion driving is performed, a display signal written into each pixel is inverted in polarity with the VCOM potential being used as a reference. When 1H inversion driving or 1F inversion driving is used together with VCOM inversion driving, in which the polarity of the VCOM potential is inverted at an interval of the 1H period or the 1F period, the polarity of a CS potential applied to the CS line 27 is also AC inverted in synchronization with the polarity of the VCOM potential. The driving method of the liquid-crystal display apparatus according to the present invention is not limited to VCOM inversion driving. Since the VCOM potential and the CS potential are almost the same, the VCOM potential and the CS potential are collectively called a common potential in the present specification.

Back to FIG. 1 again, on the glass substrate 11, where the display section 12 is disposed, for example, horizontal (H) drivers (horizontal driving circuits) 14A and 14B are also mounted at the above and below sides (in FIG. 1) of the display section 12, a vertical (V) driver (vertical driving circuit) 15 is mounted at the right-hand side of the display section 12, and reference-voltage generation circuits 16 and 17 and a control circuit 18 thereof are mounted at the left-hand side of the display section 12, as peripheral driving circuits. Here, only a part of the peripheral driving circuits are shown as examples. The peripheral driving circuits are not limited to those shown in the figure. Both the peripheral driving circuits and the pixel transistors in the display section 12 are manufactured by using low-temperature polysilicon or continuous-grain (CG) silicon.

In the driving-circuit-united-type liquid-crystal display apparatus having the above structure, the horizontal driver 14A has, for example, a digital-driver structure which includes a horizontal shift register 141, a data sampling latch section 142, a second latch section 143, a level shifter 144, and D/A conversion circuit (DAC) 145. The horizontal driver 14B has exactly the same structure as the horizontal driver 14A.

The horizontal shift register 141 starts a shift operation in response to a horizontal start pulse HST sent from a timing generation circuit, not shown, and generates sampling pulses sequentially sent in one horizontal period, in synchronization with horizontal clock pulses HCK sent from the timing generation circuit. The data sampling latch section 142 sequentially samples and latches display data input from the outside of the substrate through an interface circuit, not shown, in synchronization with the sampling pulses generated by the horizontal shift register 141.

The latched one-line digital data is collectively transferred to the second latch section during a horizontal blanking period. The second latch section 143 outputs the one-line digital data at a time. The level shifter 144 increases the magnitude of the output one-line digital data, and sends it to the D/A conversion circuit 145. The one-line digital data is converted to a one-line analog display signal by the D/A conversion circuit 145 and output to data lines 25-1 to 25-n arranged correspondingly to the number "n" of pixels in the horizontal direction in the display section 12. The D/A conversion circuit 145 will be described in further detail later.

The vertical driver 15 is formed of a vertical shift register and a gate buffer. In the vertical driver 15, the vertical shift register starts a shift operation in response to a vertical start pulse VST sent from a timing generation circuit, not shown, and generates scanning pulses sequentially sent in one vertical period, in synchronization with vertical clock pulses VCK sent from the timing generation circuit. The generated scanning pulses are sequentially output through the gate buffer to gate lines 24-1 to 24-m arranged correspondingly to the number "m" of pixels in the vertical direction in the display section 12.

When the scanning pulses are sequentially output to the gate lines 24-1 to 24-m by vertical scanning performed by the vertical driver 15, pixels are sequentially selected in units of lines in the display section 12. A one-line analog display signal output from the D/A conversion circuit 145 is written at a time through the data lines 25-1 to 25-n into the selected one-line pixels. This writing operation performed in units of lines is repeated to display an image on the screen.

Figure 3:
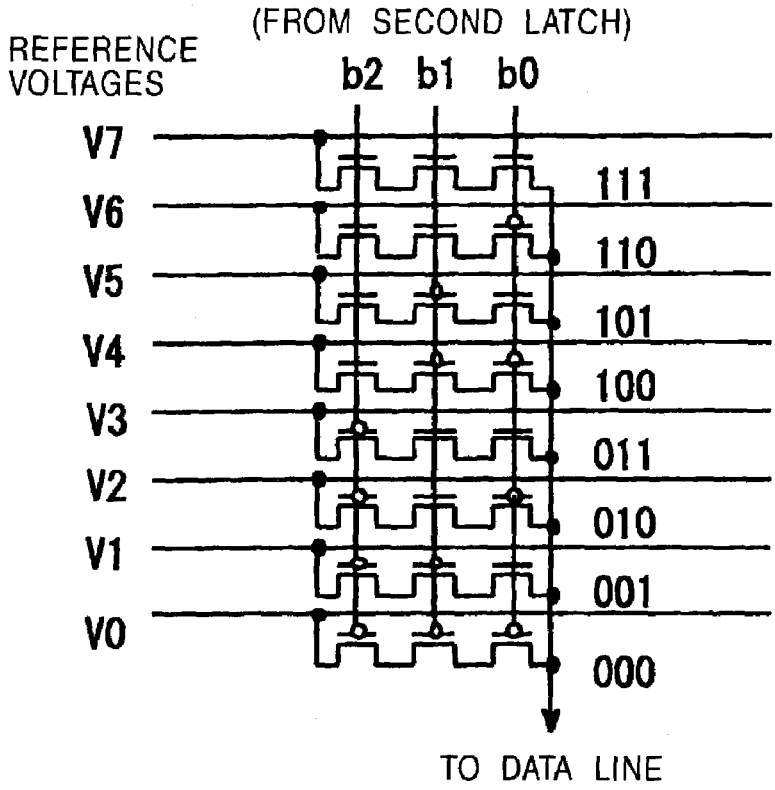
FIG. 3 is a circuit diagram showing an example structure of a reference-voltage-selection-type D/A conversion circuit.

The D/A conversion circuit 145 will be described here in further detail. In the liquid-crystal display apparatus according to the present embodiment, as the D/A conversion circuit 145, a reference-voltage-selection-type D/A conversion circuit which selects a reference voltage corresponding to a digital display signal among a plurality of reference voltages and outputs it as an analog display signal is used. FIG. 3 shows an example structure of the reference-voltage-selection-type D/A conversion circuit.

For simplicity of the figure, an example case is taken and shown in which display data has three bits b2, b1, and b0, and the three-bit display data is converted to an analog display signal having eight levels of gradations. Therefore, the present D/A conversion circuit receives eight reference voltages V0 to V7 corresponding to the eight levels of gradations. The present D/A conversion circuit is provided correspondingly to each of the data lines 25-1 to 25-n of the display section 12, and selects one voltage among the eight reference voltages V0 to V7 according to the logic combination of the bits b2, b1, and b0 of the three-bit display data, and sends it to the corresponding data line as an analog display signal.

To generate a plurality of reference voltages to be sent to the reference-voltage-selection-type D/A conversion circuit, the reference-voltage generation circuits 16 and 1 are provided. The reference-voltage generation circuit 16 generates a reference voltage for the black level. The reference-voltage generation circuit 17 generates reference voltages for gradation levels other than the black level. These reference-voltage generation circuits 16 and 17 are disposed in different areas on the glass substrate 11. More specifically, the reference-voltage generation circuit 16 for the black level is disposed in a vicinity of an input-and-output pad section 19 provided at an end section of the substrate at one of the above or below side of the display section 12, whereas the reference-voltage generation circuit 17 for the other gradation levels is disposed at an intermediate position next to the display section 12, which has almost equal distances from the horizontal drivers 14A and 14B.

To the input-and-output section 19, display data, a master clock MCK, a horizontal synchronization signal Hsync, a vertical synchronization signal Vsync, power-supply voltages VCC and VSS, and others are given from the outside of the substrate. Among them, the power-supply voltages VCC and VSS are sent to the reference-voltage generation circuit 17 for the other gradation levels by a power-supply line L1 wired on the substrate between the input-and-output pad section 19 and the reference-voltage generation circuit 17 for the other gradation levels. In the figure, only one power-supply line L1 is shown. However, actually it includes two lines, a VCC line and a VSS line.

At a position (at a point A in the figure) in a vicinity of the input-and-output pad section 19, a power-supply line L2 for the reference-voltage generation circuit 16 for the black level is connected to the power-supply line L1. The power-supply voltages VCC and VSS input to the power-supply line L1 by the input-and-output pad section 19 are also input to the power-supply line L2 at the middle (at the point A in the figure) of the power-supply line L1, and sent to the reference-voltage generation circuit 16 for the black level by the power-supply line L2. Like the power-supply line L1, the power-supply line L2 also includes two line, a VCC line and a VSS line.

Figure 4:
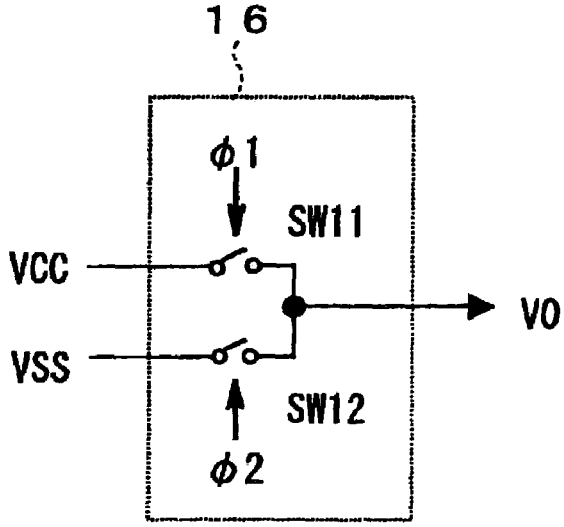
FIG. 4 is a circuit diagram showing an example specific structure of a black-level reference-voltage generation circuit.

FIG. 4 is a circuit diagram showing an example specific structure of the reference-voltage generation circuit 16 for the black level. As clear from the figure, the reference-voltage generation circuit 16 is formed of a switch SW11 having an input of the power-supply voltage VCC and a switch SW12 having an input of the power-supply voltage VSS. These switches SW11 and SW12 are provided correspondingly to AC driving of the liquid crystal, and are turned on and off by the timing pulses $\phi 1$ and $\phi 2$ alternately output from the control circuit 18 in synchronization with AC driving to output the power-supply voltage VCC or the power-supply voltage VSS as the black-level reference voltage V0.

As clear from FIG. 4, the black-level reference-voltage generation circuit 16 has a very simple circuit structure in which only the two switches SW11 and SW 12 are included. Therefore, its circuit scale is very small, and do not receive any limitation on its arrangement position on the glass substrate 11, unlike the reference-voltage generation circuit 17 for the other gradation levels, which will be described later for its specific structure. The black-level reference-voltage generation circuit 16 can be disposed at any position, and can be easily disposed even in a vicinity of the input-and-output pad section 19.

Figure 5:
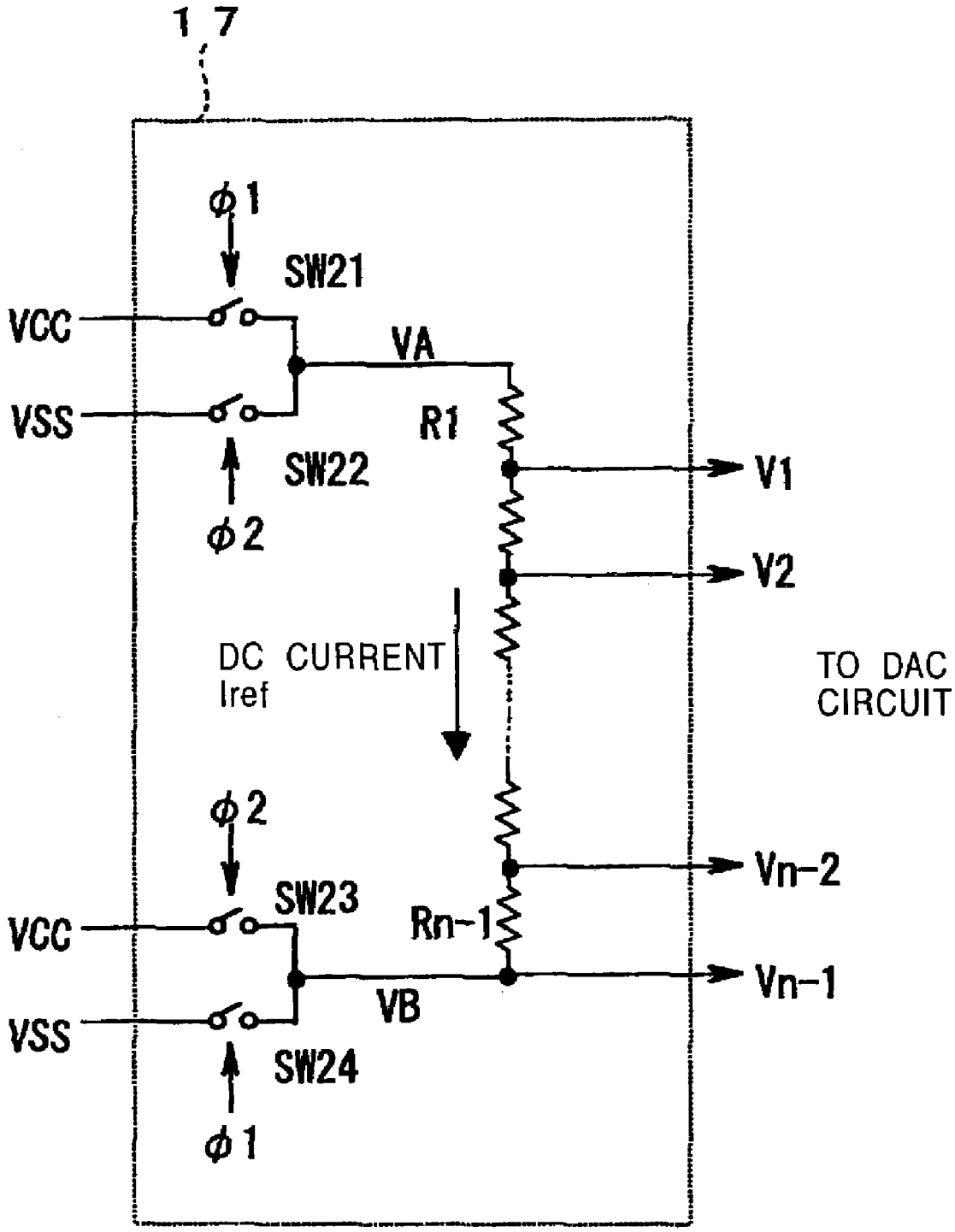
FIG. 5 is a circuit diagram showing an example specific structure of a reference-voltage generation circuit for the other gradation levels.

FIG. 5 is a circuit diagram showing an example specific structure of the reference-voltage generation circuit 17 for the other gradation levels. As clear from the figure, the reference-voltage generation circuit 17 for the other gradation levels has a resistor-division circuit structure. More specifically, when the number of gradations is "n", the voltage between a first reference potential VA and a second reference potential VB is divided by (n−1) resistors, R1 to Rn-1, connected in series. With this, (n−2) reference voltages, V1 to Vn−2, are obtained at voltage-division points. When the reference potential VB is set to a white-level reference voltage Vn−1, a total of (n−1) reference voltages, V1 to Vn−1, are generated for gradation levels other than a black level.

In the same way as in the black-level reference-voltage generation circuit 16, two switches SW21 and SW22 are provided at the first reference potential VA side, and two switches SW23 and SW24 are provided at the second reference potential VB side, correspondingly to AC driving of the liquid crystal. These switches SW21 to SW24 are turned on and off by the timing pulses $\phi 1$ and $\phi 2$ output alternately from the control circuit 18 in synchronization with AC driving.

More specifically, when the timing pulse $\phi 1$ is generated at certain inversion timing in AC inversion, since the switches SW21 and SW24 are turned on, the positive power-supply voltage VCC is given as the first reference potential VA, and the negative power-supply voltage VSS (for example, a ground level) is given as the second reference potential VB. When the timing pulse $\phi 2$ is generated at the next inversion timing, since the switches SW22 and SW23 are turned on, the negative power-supply voltage VSS is given as the first reference potential VA, and the positive power-supply voltage VCC is given as the second reference potential VB.

In the reference-voltage generation circuit 17 for the other gradation levels, gate wiring materials for transistors can be used as a resistor material for the resistors R1 to Rn−1. Gate wiring is made by a metal such as Mo (Molybdenum), which has a small dispersion in resistance. When the dispersion of the resistance of the resistors R1 to Rn−1 is small, since they can have a large resistance, an effect caused by the wiring resistor of the power-supply line L1, on the reference voltages V1 to Vn−1 is made small. The white-level reference voltage Vn−1 can be used as the common potential, described before, that is, the VCOM potential and the CS potential.

As described above, the driving-circuit-united-type liquid-crystal display apparatus according to the present embodiment has the structure in which the black-level reference-voltage generation circuit 16 is disposed in a vicinity of the input-and-output pad section 19, and the power-supply line L2 of the black-level reference-voltage generation circuit 16 is connected to the power-supply line L1 of the reference-voltage generation circuit 17 for the other gradation levels at a position in a vicinity of the input-and-output pad section 19. Therefore, the power-supply line L2 does not need to path through long on the substrate, and its wiring length can be made extremely short, which makes the resistance of the wiring resistor of the power-supply line L2 as low as it can be ignored. As a result, since a voltage drop caused by the wiring resistor of the black-level reference voltage V0 is eliminated, a sufficient contrast ratio is obtained.

On the other hand, in the reference-voltage generation circuit 17 for the other gradation levels, an effect caused by the wiring resistor of the power-supply line L1 is given to reduce the reference potentials VA and VB. Because the reference voltages generated therein are used for intermediate gradation levels, no practical problem occurs, unlike a case in which the black level is reduced. If the wiring resistor of the VCC line and that of the VSS line differ largely, when the power-supply voltage VCC and the power-supply voltage VSS are switched in synchronization with AC inversion, the reference voltages corresponding to the gradation levels are not symmetrical against the VCOM potential.

Therefore, it is preferred that the power-supply line L1 for the reference-voltage generation circuit 17 for the other gradation levels be wired such that the resistance of the wiring resistor of the VCC line and that of the VSS line match. To make the resistance of the VCC line and that of the VSS line equal, it is preferred that layout be made such that the wiring widths and wiring lengths on the substrate of both lines are as close as possible. With this, the reference voltages corresponding to the gradation levels are made symmetrical against the VCOM potential. As a result, a burning phenomenon and the deterioration of reliability in intermediate gradation levels are prevented. Even if the resistance of the VCC line and that of the VSS line do not exactly match, when both lines are wired such that their resistances are within an error of about 20% or less, the level differences caused by the reference voltages against the VCOM potential when the power-supply voltages VCC and VSS are switched is suppressed to a range where the burning phenomenon and the deterioration of reliability do not cause a practical problem in intermediate gradation levels.

In the present embodiment, the case has been described as an example, in which the black-level reference-voltage generation circuit 16 is separated from the reference-voltage generation circuit 17 for the other gradation levels and disposed in a vicinity of the input-and-output pad section 19, and the power-supply line L2 of the black-level reference-voltage generation circuit 16 is connected to the power-supply line L1 of the reference-voltage generation circuit 17 for the other gradation levels at a position in a vicinity of the input-and-output pad section 19. Another embodiment may be configured such that a white-level reference-voltage generation circuit is separated from a reference-voltage generation circuit for the other gradation levels and disposed in a vicinity of the input-and-output pad section 19, and the power-supply line of the white-level reference-voltage generation circuit is connected to the power-supply line of the reference-voltage generation circuit for the other gradation levels at a position in a vicinity of the input-and-output pad section 19. It is also possible that the same structure is applied to both black-level and white-level reference-voltage generation circuits.

It can be generally said that, in normally-white-mode liquid-crystal display apparatuses, it is effective that a black-level reference-voltage generation circuit or both black-level and white-level reference-voltage generation circuits are separated from a reference-voltage generation circuit for the other gradation levels, and in normally-black-mode liquid-crystal display apparatuses, it is effective that a white-level reference-voltage generation circuit or both black-level and white-level reference-voltage generation circuits are separated from a reference-voltage generation circuit for the other gradation levels.

In the present embodiment, the power-supply line L2 of the black-level reference-voltage generation circuit 16 is connected to the power-supply line L1 of the reference-voltage generation circuit 17 for the other gradation levels at a position in a vicinity of the input-and-output pad section 19. The power-supply line L2 of the black-level reference-voltage generation circuit 16 may be connected through the input-and-output section 19 to a power-supply line at the outside of the substrate. Also in this case, since the power-supply line L2 does not need to path through long on the substrate and therefore its wiring length becomes short, the wiring resistance of the power-supply line L2 can be suppressed to a level which can be ignored.

Further, in the present embodiment, the case in which the present invention is applied to the liquid-crystal display apparatus formed of the liquid-crystal cells serving as display elements has been described as an example. The present invention is not limited to this case. The present invention can also be applied to any display apparatuses in which a data processing circuit is mounted on the same substrate as a display section is mounted, such as electroluminescence (EL) display apparatuses which use EL elements as display elements.

In many cases, the VCOM potential and the CS potential are equal to the white-level reference voltage Vn−1 in normally-white-mode liquid-crystal display apparatuses, and the VCOM potential and the CS potential are equal to the black-level reference voltage V0 in normally-black-mode liquid-crystal display apparatuses. Therefore, as described before, the reference-voltage generation circuit for generating the reference voltages V0 to Vn−1 are also used as a circuit for generating the VCOM potential and the CS potential, conventionally.

In this case, however, when the liquid-crystal display apparatus according to the present embodiment is taken as an example, the VCOM potential and the CS potential sustain the effect of voltage drops at the reference potentials VA and VB caused by the DC current Iref flowing through the resistor-division circuit in the reference-voltage generation circuit 17 for the other gradation levels and by the wiring resistor of the power-supply line L1 due to long wiring on the substrate, and contrast deteriorates. To overcome this issue, a driving-circuit-united-type liquid-crystal display apparatus according to a second embodiment, described below, is made.

Second Embodiment

Figure 6:
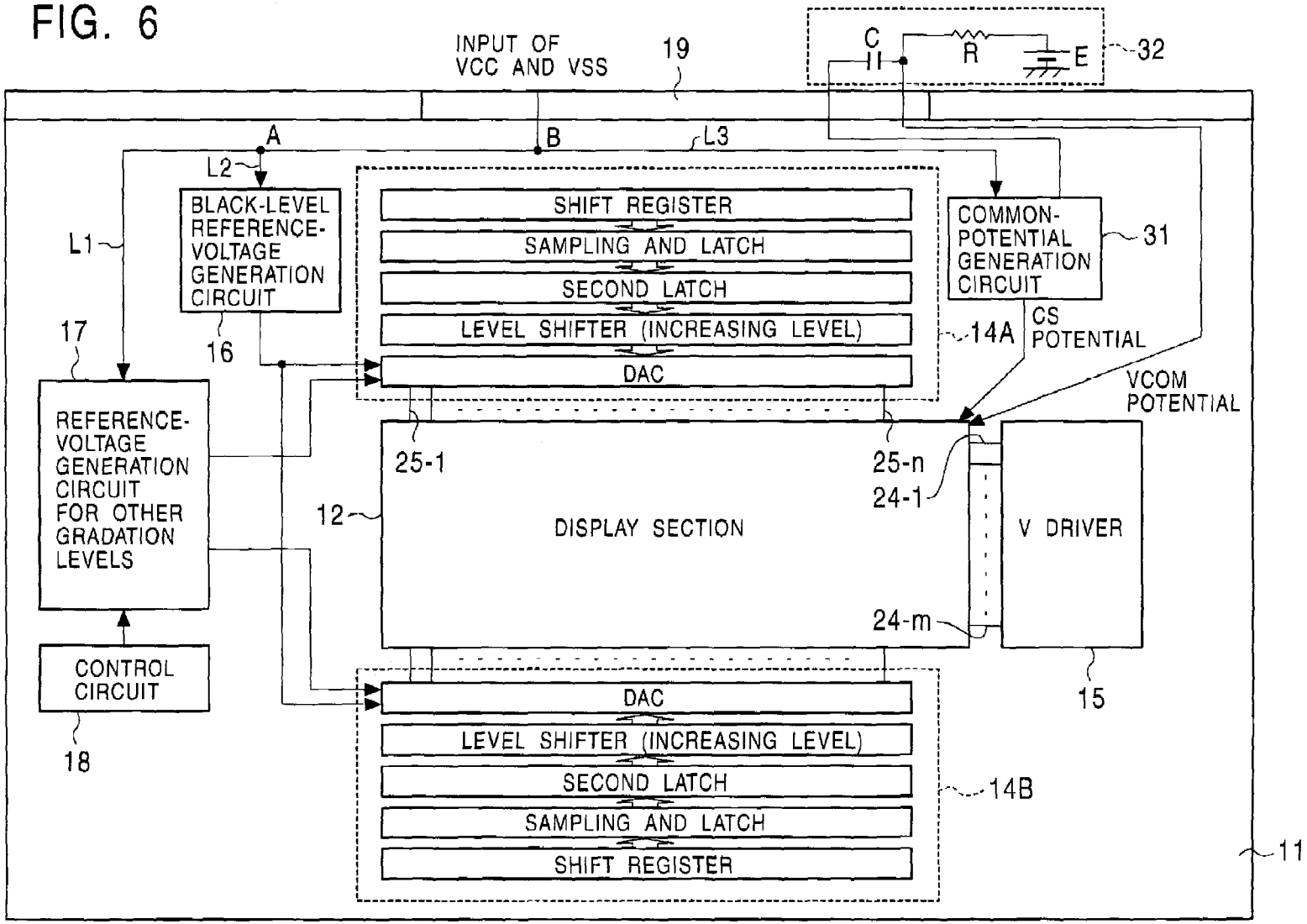
FIG. 6 is a block diagram showing an example structure of a liquid-crystal display apparatus which serves as an example of a driving-circuit-united-type display apparatus according to a second embodiment of the present invention.

FIG. 6 is a block diagram showing an example structure of a driving-circuit-united-type display apparatus according to the second embodiment of the present invention. In the figure, the same symbols as those used in FIG. 1 are assigned to the portions which are the same as or similar to those shown in FIG. 1.

In FIG. 6, in the same way as in the liquid-crystal display apparatus according to the first embodiment, a black-level reference-voltage generation circuit 16 is separated from a reference-voltage generation circuit 17 for the other gradation levels and disposed in a vicinity of an input-and-output pad section 19, and the power-supply line L2 of the black-level reference-voltage generation circuit 16 is connected to the power-supply line L1 of the reference-voltage generation circuit 17 for the other gradation levels at a position in a vicinity of the input-and-output pad section 19.

In addition to this structure, in the liquid-crystal display apparatus according to the present invention, the reference-voltage generation circuit 17 for the other gradation levels is not used also as a circuit (hereinafter called a common-potential generation circuit) for generating a common potential, which is the collective name of a VCOM potential and a CS potential (as described before, in the present specification, the VCOM potential and the CS potential are collectively called a common potential), but a common-potential generation circuit 31 is separated from the reference-voltage generation circuit 17 for the other gradation levels.

Figure 7:
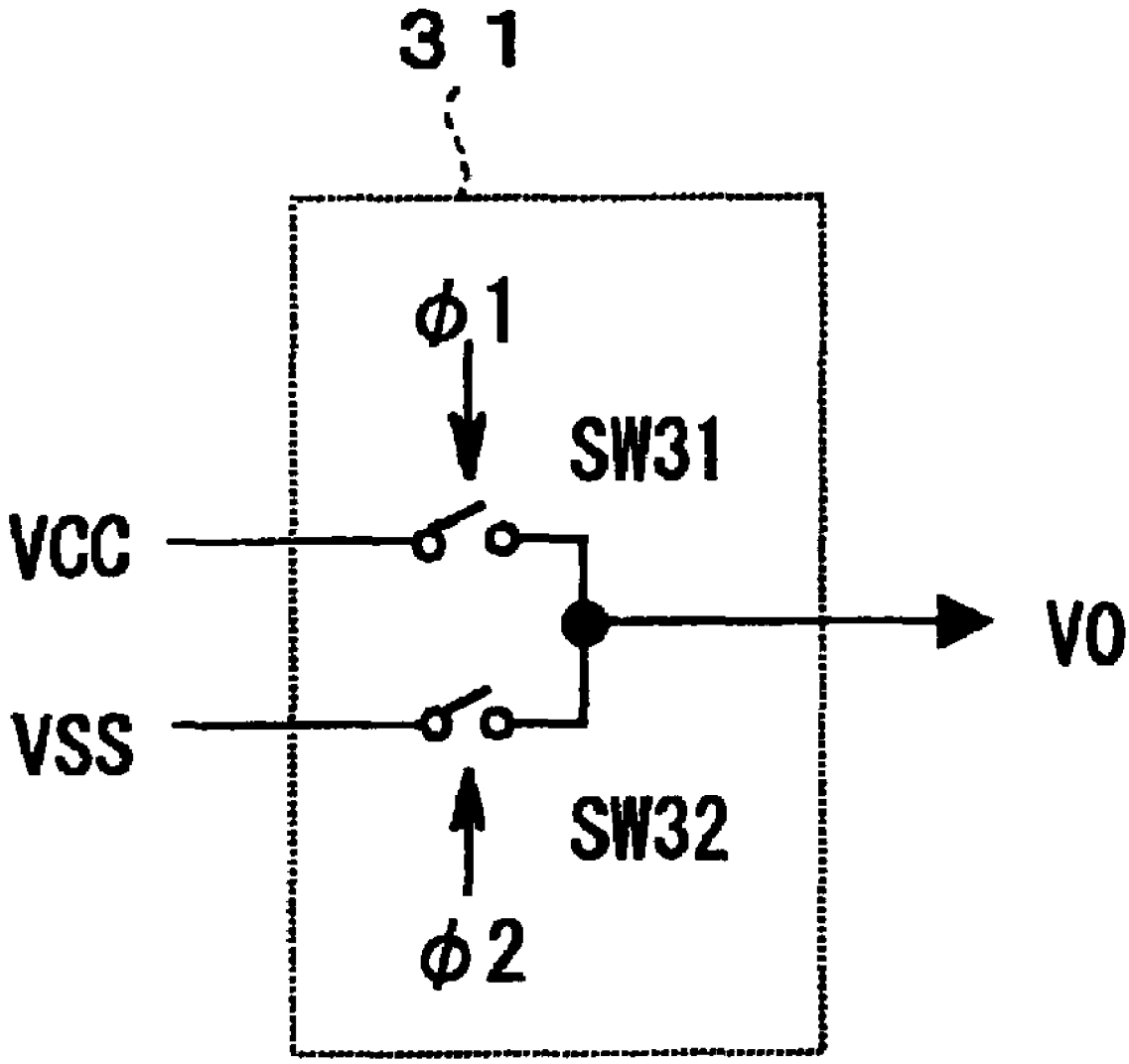
FIG. 7 is a circuit diagram showing an example specific structure of a common-potential generation circuit.

FIG. 7 shows an example specific structure of the common-potential generation circuit 31. This common-potential generation circuit basically has the same structure as the black-level reference-voltage generation circuit 16 described before. More specifically, the black-level reference-voltage generation circuit 16 is formed of a switch SW31 having an input of a power-supply voltage VCC and a switch SW32 having an input of a power-supply voltage VSS. These switches SW31 and SW32 are turned on and off by timing pulses $\phi 1$ and $\phi 2$ alternately output from a control circuit 18 in synchronization with AC driving to output the power-supply voltage VCC or the power-supply voltage VSS as the common potential, that is, as the VCOM potential and the CS potential.

As clear from FIG. 7, the common-potential generation circuit 31 has a very simple circuit structure in which only the two switches SW31 and SW32 are included, in the same way as the black-level reference-voltage generation circuit 16. Therefore, its circuit scale is very small, and do not receive any limitation on its arrangement position on a glass substrate 11. The common-potential generation circuit 31 can be disposed at any position, and can be easily disposed even in a vicinity of the input-and-output pad section 19. The power-supply line L3 of the common-potential generation circuit 31 is connected to the power-supply line L1 of the reference-voltage generation circuit 17 for the other gradation levels in a vicinity (at point B in the figure) of the input-and-output pad section 19.

An AC voltage having almost the same amplitude as the CS potential is sued as the VCOM potential. In the pixel circuit shown in FIG. 2, when a signal is written into the pixel electrode of the liquid-crystal cell 22 from the data line 25 through the TFT 21, a voltage drop actually occurs in the TFT 51 due to a parasitic capacitor. Therefore, it is necessary to use an AC voltage DC-shifted by the voltage drop as the VCOM potential. For example, a VCOM adjustment circuit 32 provided at the outside of the substrate performs this DC shift for the VCOM potential.

The CS potential generated by the common-potential generation circuit 31 is given directly to each pixel circuit in the display section 12. The nominal VCOM potential having the same potential as the CS potential is output to the outside of the substrate from the input-and-output pad section 19, and sent to the VCOM adjustment circuit 32. The VCOM adjustment circuit 32 is formed, for example, of a capacitor C, a resistor R, and a DC power supply V, and adjusts the DC level of the nominal VCOM potential generated by the common-potential generation circuit 31 to obtain the actual VCOM potential. The actual VCOM potential is input to the substrate from the input-and-output pad section 19 and given to each pixel circuit in the display section 12.

As described above, the driving-circuit-united-type liquid-crystal display apparatus according to the present embodiment has the structure in which the common-potential generation circuit 31 is separated from the reference-voltage generation circuit 17 for the other gradation levels and disposed in a vicinity of the input-and-output pad section 19, and the power-supply line L3 of the common-potential generation circuit 31 is connected to the power-supply line L1 of the reference-voltage generation circuit 17 for the other gradation levels at a position in a vicinity of the input-and-output pad section 19. Therefore, the power-supply line L3 does not need to path through long on the substrate, and its wiring length can be made extremely short, which makes the resistance of the wiring resistor of the power-supply line L3 as low as it can be ignored.

With this, the VCOM potential and the CS potential do not sustain the effect of voltage drops at the reference potentials VA and VB caused by the DC current Iref flowing through the resistor-division circuit in the reference-voltage generation circuit 17 for the other gradation levels and by the wiring resistor of the power-supply line L1 due to long wiring on the substrate; the-resistance of the wiring resistor of the power-supply line L3 is as low as it can be ignored; and there is no voltage drop caused by the wiring resistor of the power-supply line L3. Therefore, contrast deterioration does not occur.

In the present embodiment, the power-supply line L3 of the common-potential generation circuit 31 is connected to the power-supply line L1 of the reference-voltage generation circuit 17 for the other gradation levels at a position in a vicinity of the input-and-output pad section 19. The power-supply line L2 of the common-potential generation circuit 31 may be connected through the input-and-output section 19 to a power-supply line at the outside of the substrate. In this case, since the power-supply line L3 does not need to path through long on the substrate and therefore its wiring length becomes short, the wiring resistance of the power-supply line L3 can be suppressed to a level which can be ignored.

Display apparatuses typical of which are the liquid-crystal display apparatuses according to the first and second embodiments are suited to screen display section of compact and lightweight portable terminals typical of which area portable telephones and personal digital assistants (PDAs or portable information terminals).

Application Example

Figure 8:
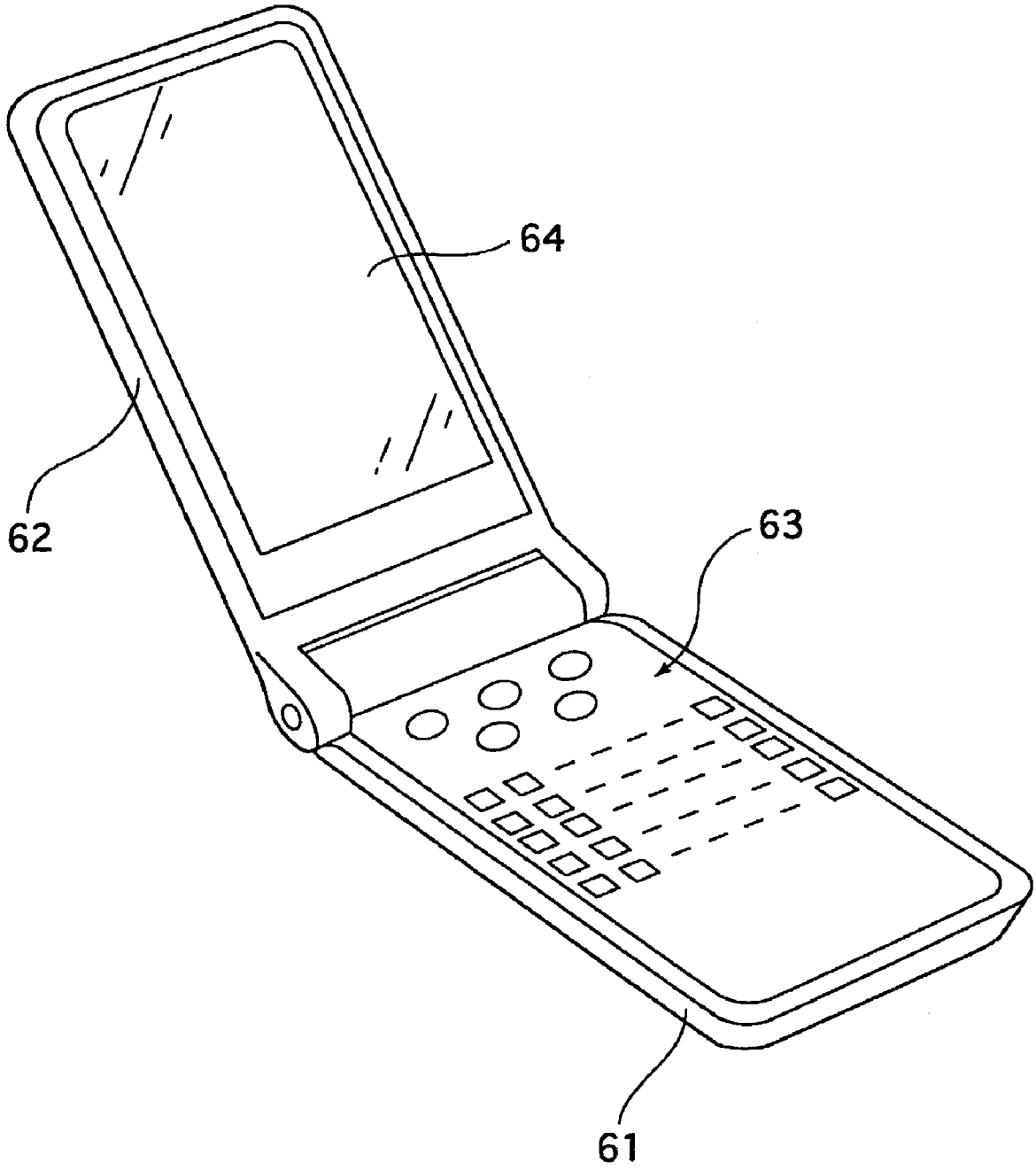
FIG. 8 is a perspective view showing an outlined structure of a PDA which serves as an example of a portable terminal according to the present invention.
Figure 9:
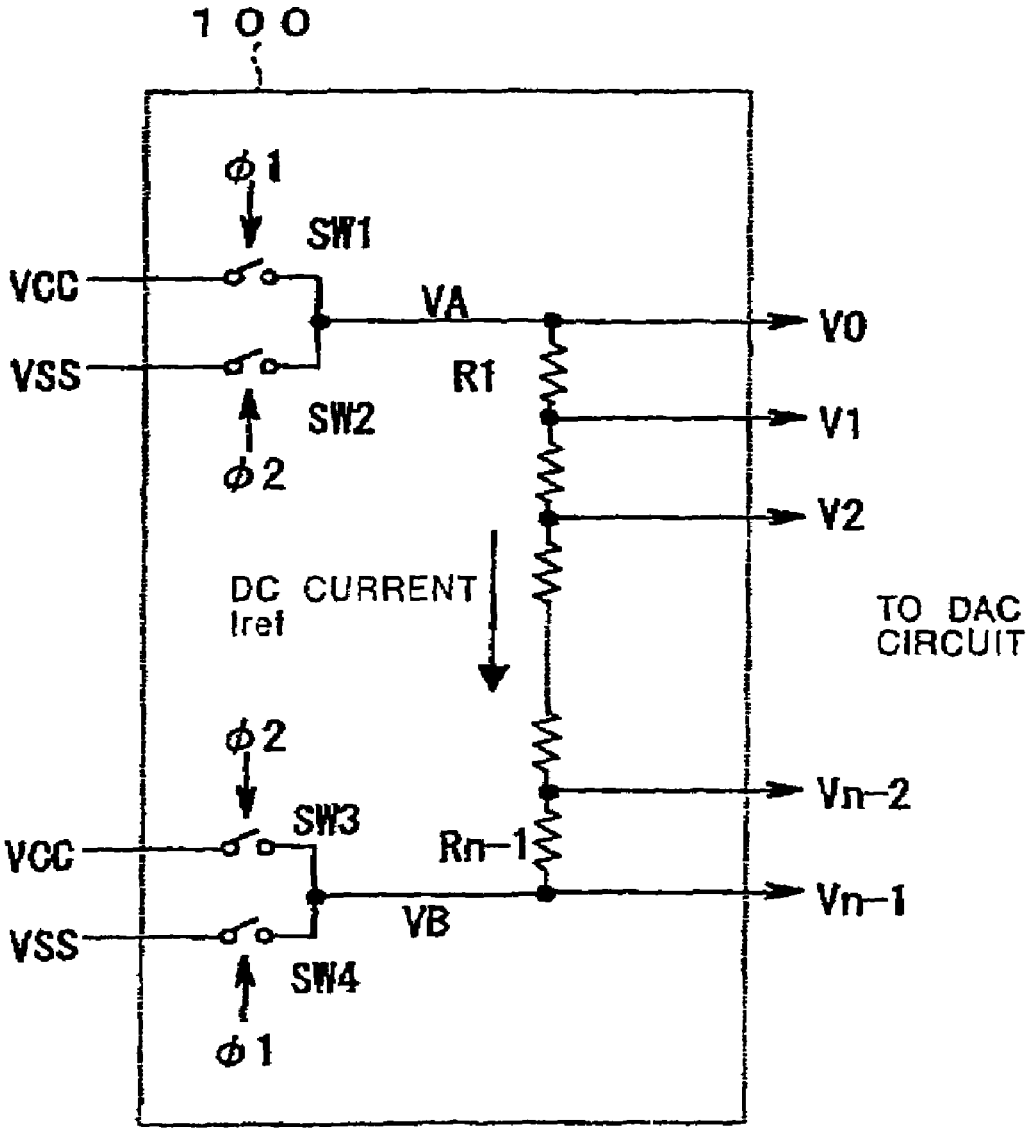
FIG. 9 is a circuit diagram showing a basic structure of a reference-voltage generation circuit.
Figure 10:
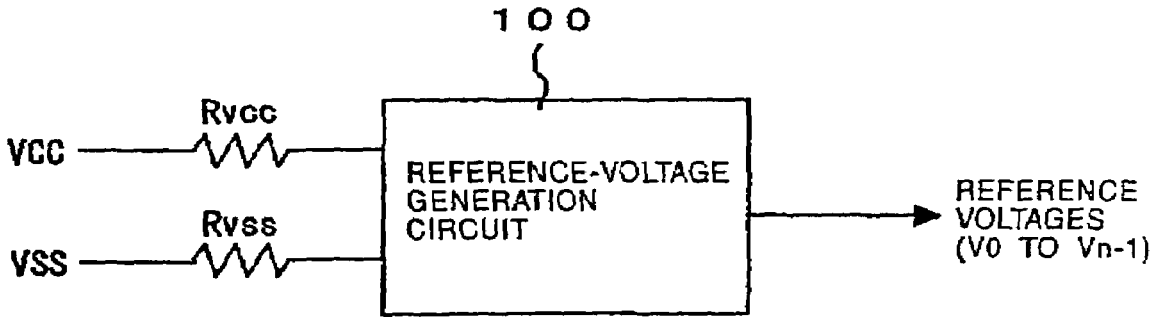
FIG. 10 is a view used for describing an issue for a related art.
Figure 11:
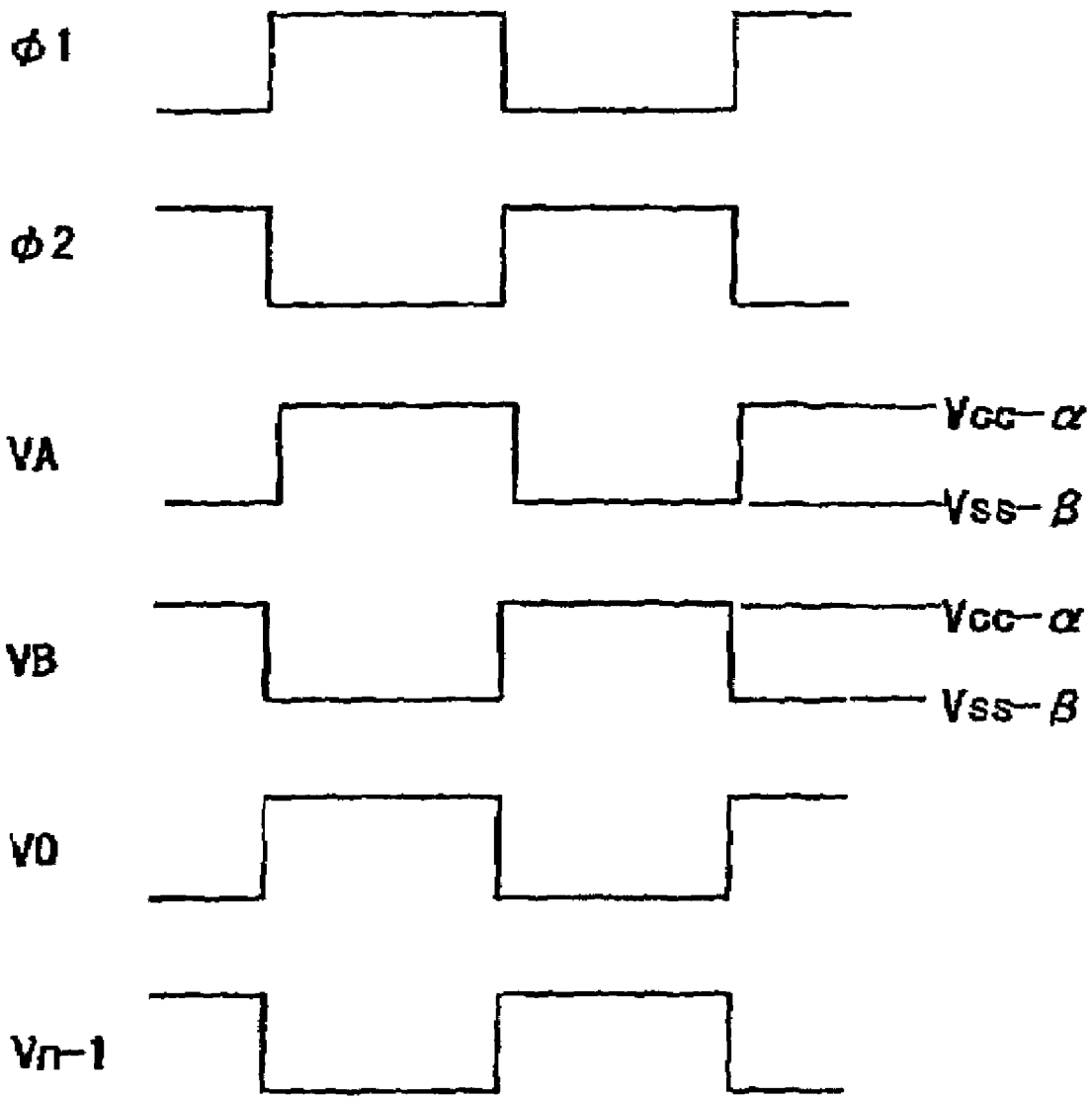
FIG. 11 is a waveform view of the reference-voltage generation circuit having the basic structure.

FIG. 8 is a perspective view showing an outlined structure of a PDA which serves as an example of a portable terminal according to the present invention.

The PDA according to the present application case has a folding structure in which a cover 62 is provided for an apparatus body 61 such that the cover can be freely opened and closed. On the upper surface of the apparatus body 61, an operation section 63 formed of various keys, including a keyboard, is disposed. The cover is provided with a screen display section 64. As this screen display section 64, one of the driving-circuit-united-type liquid-crystal display apparatuses according to the first and second embodiments, described before, is used.

As described above, in the liquid-crystal display apparatuses according to the first and second embodiments, the effect of the voltage drops caused by the wiring resistors of the power-supply lines of the reference-voltage generation circuit used in the D/A conversion circuit and the common-potential generation circuit for the VCOM potential and the CS potential is eliminated, and a sufficient contrast ratio is obtained. Therefore, when the liquid-crystal display apparatus according to one of these embodiments is mounted as the screen display section 64, a high-quality screen display with a good contrast ratio is allowed. In addition, since the driving circuits are united, the PDA can be made compact.

The liquid-crystal display apparatuses according to the present invention have been applied to the PDA. The application example is not limited to this case. Liquid-crystal display apparatuses according to the present invention are especially suited to compact and lightweight portable terminals, such as portable telephones.

As described above, according to the present invention, when the reference-voltage generation circuit for the black level, the reference-voltage generation circuit for the white level, or the reference-voltage generation circuits for the black and white levels are disposed in vicinities of the input-and-output pad section, and the power-supply line or lines thereof are connected to the power-supply line of the reference-voltage generation circuit for the other gradation levels in vicinities of the input-and-output pad section or at the outside of the substrate, since the voltage drop or drops of the black-level reference voltage, the white-level reference voltage, or the black-level and white-level reference voltages caused by the wiring resistor or resistors of the power-supply line or lines are eliminated, a sufficient contrast ratio is obtained.

What is claimed is:

1. A display apparatus comprising: a display section in which pixels are arranged in a matrix mariner on a transparent, insulating substrate; and a reference-voltage generation circuit mounted on the transparent, insulating substrate, for generating a plurality of reference voltages corresponding to a plurality of gradation levels, wherein the reference-voltage generation circuit comprises a first voltage generation circuit which generates a black level, a white level, or the black and white levels, and a second voltage generation circuit which generates the plurality of gradation levels, the first and second voltage generation circuits being connected in parallel at different areas on the transparent, insulating substrate, and the first voltage generation circuit is disposed in a vicinity of an input section for inputting electric power from an outside of the substrate into an inside of the substrate.

2. A display apparatus according to claim 1, wherein a power-supply line for the first voltage generation circuit is connected to a power-supply line for supplying electric power to the second voltage generation circuit, in a vicinity of the input section or at the outside of the substrate.

3. A display apparatus according to claim 2, wherein the power-supply lines are wired such that the resistance of the wiring resistor of a positive line and the resistance of the wiring resistor of a negative line are almost equal.

4. A display apparatus according to claim 1, wherein the second voltage generation circuit is formed of a resistor division circuit in which resistors made from a transistor gate wiring material are connected in series between two reference potentials, and voltages generated at the connection points of the resistors serve as reference voltages for the other gradation levels.

5. A display apparatus according-to claim 1, wherein the display apparatus is a liquid-crystal display apparatus in which each pixel includes a liquid-crystal cell; the liquid crystal display apparatus comprises potential generation means mounted on the transparent, insulating substrate together with the display section, for generating a common potential for each pixel in common at an opposite electrode of the pixel; and the potential generation means is disposed in a vicinity of the input section.

6. A display apparatus according to claim 5, wherein a power-supply line for the potential generation means is connected to a power-supply line for supplying electric power to the second, voltage generation circuit, in a vicinity of the input section or at the outside of the substrate.

7. A portable terminal comprising a display apparatus as a screen display Section, wherein the display apparatus comprises:

a display section in which pixels are arranged in a matrix manner on a transparent, insulating substrate; and a reference-voltage generation circuit mounted on the transparent, insulating substrate together with the display section, for generating a plurality of reference voltages, wherein the reference-voltage generation circuit comprises a first voltage generation circuit for generating a black level, a white level, or the black and white levels, and a second voltage generation circuit for generating a plurality of gradation levels, the first and second voltage generation circuits being disposed at different areas on the transparent, insulating substrate, and the first voltage generation circuit is disposed in a vicinity of an input section for inputting electric power from the outside of the substrate into the inside of the substrate.

8. A portable terminal according to claim 7, wherein a power-supply line for the first voltage generation circuit is connected to a power-supply line for supplying electric power to the second voltage generation circuit, in a vicinity of the input section or at the outside of the substrate.

9. A portable terminal according to claim 7, wherein the display apparatus is a liquid-crystal display apparatus;

the liquid-crystal display apparatus comprises potential generation means mounted on the transparent, insulating substrate together with the display section, for generating, a common potential for each pixel in common at an opposite electrode of the pixel; and the potential generation means is disposed in a vicinity of the input section.

10. A portable terminal according to claim 9, wherein a power-supply line for the potential generation means is connected to a power-supply line for supplying electric power to the second voltage generation circuit, in a vicinity of the input section or at the outside of the substrate.

11. A display apparatus according to claim 1, wherein the first voltage generation circuit outputs a power-supply voltage VCC or VSS as a black level, a white level, or black and white-level reference voltages.

12. A display apparatus according to claim 1, wherein the display apparatus further comprises a reference-voltage-selection-type D/A conversion circuit which selects a reference voltage corresponding to a digital display signal among said plurality of reference voltages from the first and the second voltage generation circuits.

13. A display apparatus comprising:

a display section in which pixels are arranged in a matrix manner on a transparent, insulating substrate; and a first voltage generation circuit which generates a black level, a white level, or the black and white levels;

and a second voltage generation circuit which generates a plurality of reference voltages corresponding to gradation levels; and wherein the first voltage generation circuit is disposed in a vicinity of an input section for inputting electric power from an outside of the substrate into an inside of the substrate and the second voltage generation circuit is spaced from said first voltage generation circuit, wherein a power-supply line for the first voltage generation circuit is connected to a power-supply line for supplying electric power to the second voltage generation, circuit, in a vicinity of the input section or at the outside of the substrate.

14. A display apparatus according to claim 13, wherein the power-supply lines are wired such that the resistance of the wiring resistor of a positive line and the resistance of the wiring resistor of a negative line are almost equal.

15. A display apparatus comprising:

a display section in which pixels are arranged in a matrix manner on a transparent, insulating substrate; and a first voltage generation circuit which generates a black level, a white level, or the black and white levels;

and a second voltage generation circuit which generates a plurality of reference voltages corresponding to gradation levels; and wherein the first voltage generation circuit is disposed in a vicinity of an input section for inputting electric power from an outside of the substrate into an inside of the substrate and the second voltage generation circuit is spaced from said first voltage generation circuit, wherein the second voltage generation circuit is formed of a resistor division circuit in which resistors made from a transistor gate wiring material are connected in series between two reference potentials, and voltages generated at the connection points of the resistors serve as reference voltages for the plurality of gradation levels.

16. A display apparatus comprising:

a display section in which pixels are arranged in a matrix manner on a transparent, insulating substrate; and a first voltage generation circuit which generates a black level, a white level, or the black and white levels;

and a second voltage generation circuit which generates a plurality of reference voltages corresponding to gradation levels; and wherein the first voltage generation circuit is disposed in a vicinity of an input section for inputting electric power from an outside of the substrate into an inside of the substrate and the second voltage generation circuit is spaced from said first voltage generation circuit, wherein the display apparatus is a liquid-crystal display apparatus in which each pixel includes a liquid-crystal cell; the Liquid crystal display apparatus comprises potential generation means mounted on the transparent, insulating substrate together with the display section, for generating a common potential for each pixel in common at an opposite electrode of the pixel; and the potential generation means is disposed in a vicinity of the input section.

17. A display apparatus according to claim 16, wherein a power-supply line for the potential generation means is connected to a power-supply line for supplying electric power to the second voltage generation circuit in a vicinity of the input section or at the outside of the substrate.

18. A portable terminal having:

a display section in which pixels are arranged in a matrix manner on a transparent, insulating substrate; and a first voltage generation circuit which generates a black level, a white level or the black and white levels;

and a second voltage generation circuit which generates a plurality of reference voltages corresponding to gradation levels; and wherein the first voltage generation circuit is disposed in a vicinity of an input section for inputting electric power from an outside of the substrate into an inside of the substrate and the second voltage generation circuit is spaced from said first voltage generation circuit, wherein a power-supply line for the first voltage generation circuit is connected to a power-supply line for supplying electric power to the second voltage generation circuit, in a vicinity of the input section or at the outside of the substrate.

19. A portable terminal according to claim 18, wherein the power-supply lines are wired such that the resistance of the wiring resistor of a positive line and the resistance of the wiring resistor of a negative line are almost equal.

20. A portable terminal having:

a display section in which pixels are arranged in a matrix manner on a transparent, insulating substrate; and a first voltage generation circuit which generates a black level, a white level, or the black and white levels;

and a second voltage generation circuit which generates a plurality of reference voltages corresponding to gradation levels; and wherein the first voltage generation circuit is disposed in a vicinity of an input section for inputting electric power from an outside of the substrate into an inside of the substrate and the second voltage generation circuit is spaced from said first voltage generation circuit, wherein the second voltage generation circuit is formed of a resistor division circuit in which resistors made from a transistor gate wiring material are connected in series between two reference potentials, and voltages generated at the connection points of the resistors serve as reference voltages for the plurality of gradation levels.

21. A portable terminal having:

a display section in which pixels are arranged in a matrix manner on a transparent, insulating substrate; and a first voltage generation circuit which generates a black level, a white level, or the black and white levels;

and a second voltage generation circuit which generates a plurality of reference voltages corresponding to gradation levels; and wherein the first voltage generation circuit is disposed in a vicinity of an input section for inputting electric power from an outside of the substrate into an inside of the substrate and the second voltage generation circuit is spaced from said first voltage generation circuit, wherein the display apparatus is a liquid-crystal display apparatus in which each pixel includes a liquid-crystal cell; the liquid crystal display apparatus comprises potential generation means mounted on the transparent, insulating substrate together with the display section, for generating a common potential for each pixel in common at an opposite electrode of the pixel; and the potential generation means is disposed in a vicinity of the input section.

22. A portable terminal according to claim 21, wherein a power-supply line for the potential generation means is connected to a power-supply line for supplying electric power to the second voltage generation circuit, in a vicinity of the input section or at the outside of the substrate.

* * * * *